United States Patent [19]

Dunlap et al.

[11] 3,992,783

[45] Nov. 23, 1976

[54] RECOIL RESISTANT MOUNTING SYSTEM

[75] Inventors: Norman D. Dunlap, New Bremen, Ohio; Glenn E. Rickert, Huntington, Ind.

[73] Assignee: Precision Tool & Machine Co., New Bremen, Ohio ; by said Dunlap

[22] Filed: Mar. 27, 1975

[21] Appl. No.: 562,498

[52] U.S. Cl. ..... 33/250

[51] Int. Cl.[2] ..... F41G 1/38

[58] Field of Search ..... 356/251, 252; 33/245, 33/246, 247, 248, 249, 250

[56] References Cited

UNITED STATES PATENTS

| | | | |
|---|---|---|---|
| 1,905,070 | 4/1933 | Steinle | 33/245 |
| 2,123,273 | 7/1938 | Burton | 33/233 |
| 2,202,000 | 5/1940 | Gray | 33/245 |
| 2,641,057 | 6/1953 | Moore | 33/250 |
| 3,153,856 | 10/1964 | Felix | 33/247 |

*Primary Examiner*—Steven L. Stephan

[57] ABSTRACT

A system for mounting optical sights is disclosed employing an elongated mounting base for attaching a sighting device to a firearm having a dovetail portion extending in the direction of elongation to form a pair of spaced apart sight clamp accepting grooves which extend parallel to one another in the direction of elongation. First and second recoil lugs extending away from the dovetail portion in opposite directions are also disclosed with the first lug engaging the firearm to prevent movement of the base relative to the firearm when the firearm is discharged and the second lug engaging the sighting device to similarly prevent movement of the sighting device relative to the base when the firearm is discharged. The dovetail portion slidably accepts complementarily contoured portions of the sighting device which may include a pair of spaced apart clamping legs for slidably engaging the grooves and tightening means between the legs to draw those legs toward each other to grip the base.

4 Claims, 9 Drawing Figures

RECOIL RESISTANT MOUNTING SYSTEM

BACKGROUND OF THE INVENTION

The present invention relates generally to adapters for affixing one structure to another and more particularly to a mounting base for attaching a sighting device to a firearm.

Numerous systems for attaching sighting devices to firearms are known and vary in complexity from the direct attachment of fixed "iron" sights to the firearm for example by means of mounting screws to rather involved base ring arrangements for supporting telescopic sights where the adjustment features for the sight are in the mounting base. Mounting bases are typically employed for attaching telescopic sights to rifles and less frequently for attaching low power telescopic sights to hand guns. In either environment however, the approach is to attach a base or one or more blocks directly to the firearm using machine screws and to then attach the telescopic sight to the base or blocks with mounting rings which encircle the cylindrical body of the telescope. Any of numerous schemes are currently used for attaching the rings to the base or blocks. A direct mounting feature for telescopic sights is sometimes employed with low powered rifles wherein the mounting rings clamp into a pair of grooves cut directly in the receiver of the rifle however this last approach has not met with much acceptance for larger weapons wherein the recoil or other impact may be sufficient to slide the clamping rings and telescope forward or backward along the grooves in the receiver.

Optical sighting devices employing other than the simple cylindrical tube construction of telescopic sights have appeared in recent years and are typified by U.S. Pat. Nos. 3,439,970; 3,524,710; 3,645,635; and 3,836,263 as well as copending applications Ser. Nos. 402,376; 460,216; and 525,094. This last mentioned copending application entitled Low Profile Gun Sight was filed on an even date herewith and is intimately related to the present disclosre. The disclosure of the last mentioned copending application is therefore specifically incorporated herein by reference.

The foregoing nontelescopic optical sights have been provided with adapters for attaching the sights to standard telescope mounting bases and other highly specialized schemes have been devised for attaching these sights to specific firearms, however, these mounting schemes suffer from one or more of the following drawbacks:

they permanently deface the firearm resulting in a diminution of the resale value of the firearm if the sight is not sold therewith;

they are large and awkward and, therefore, not only are they not aesthetically pleasing, they are further not suitable for hand gun application;

they are not sufficiently secure to prevent sight movement and resultant loss of aiming point when deployed on a heavy recoil weapon; and they are not compatible with a wide variety of optical sighting devices or for that matter with a wide variety of firearms.

SUMMARY OF THE INVENTION

Among the several objects of the present invention may be noted the provision of an elongated mounting base for attaching a sighting device to a firearm which is not plagued with the foregoing defects; the provision of a sight mounting base which is affixable to a firearm for replacing iron sights with an optical sight; the provision of an optical sight mounting system requiring minimum modification to the firearm and characterized by its economy of manufacutre and ease of installation; and the provision of an optical sight mounting system which is highly recoil resistant to insure that the sight does not shift relative to the firearm when that firearm is discharged.

In general and in one form of the invention, an elongated mounting base for attaching a sighting device to a firearm includes a dovetail portion extending in the direction of elongation forming a pair of grooves extending parallel to one another in the direction of elongation for slidably accepting complementarily contoured portion of a sighting device with the base including a forward movement stop for limiting the sliding movement of the sighting device in the direction of elongation.

Also in general, an optical sight mounting system is provided having an elongated mounting base with a pair of spaced apart longitudinally extending grooves and at least one recoil lug extending generally perpendicular to the grooves. The grooves accept an optical sight having a pair of spaced apart clamping legs for slidably engaging the grooves and tightening means for drawing those legs toward each other to grip the base. The sight has a recoil lug engaging surface so that forward sight may be slidingly engaged with the base, slid fordward toward the recoil lug until the surface engages the recoil lug and thereafter the legs drawn toward each other to grip the base with the engaged lug and surface precluding further forward sliding movement of the sight relative to the base.

The subject matter regarded as the present invention is particularly pointed out and distinctly claimed in the concluding portion of this specification. The invention itself however together with further objects and advantages thereof may best be understood by reference to the following detailed description taken in conjunction with the accompanying drawing.

DESCRIPTION OF THE PREFERRED EMBODIMENT

Figure 1:
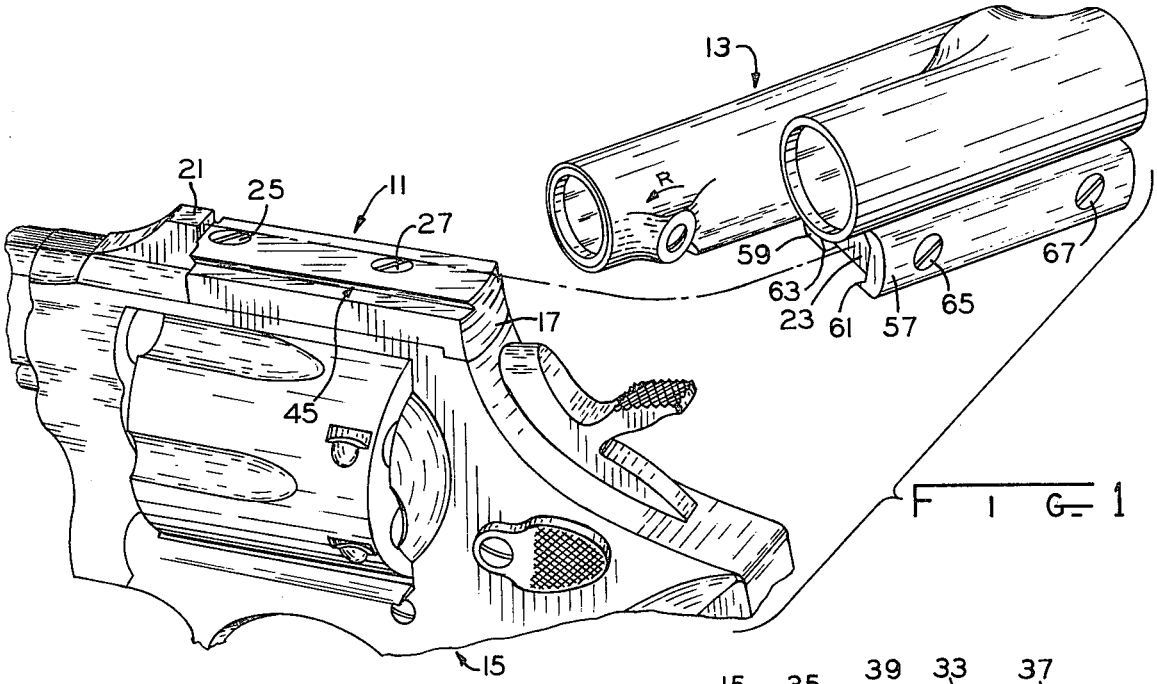
FIG. 1 is a perspective view of an exemplary firearm of conventional design with the mounting base of the present invention in place and illustrating the subsequent sliding engagement of an optical sighting device with the base.
Figure 7:
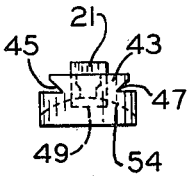
FIG. 7 is a rear end view of the mounting base of FIG. 1.

In FIG. 1 a elongated mounting base 11 for attaching a sighting device 13 to a firearm 15 has an upper dovetail portion 43 (more easily seen in FIGS. 7 and 8) which extends in the direction of elongation and forms a pair of parallel grooves 45 and 47, also extending in the direction of elongation which is essentially the same as the direction of the axis of the firearm barrel. A first recoil lug or forward movement stop means 17 (more clearly seen in FIGS. 4 and 6) extends away from the dovetail portion for engaging the firearm at 19 (FIG. 9) to prevent movement of the base 11 relative to the firearm 15 when that firearm is discharged. A second recoil lug 21 extends away from the dovetail portion in a direction opposite to that of the first recoil lug 17 and engages a recoil lug engaging surface 23 when the sight is slidingly engaged with the base to prevent movement of the sighting device relative to the base when the firearm is discharged. The base 11 is attached to the firearm 15 by means such as a pair of mounting screws 25 and 27 which pass through countersunk apertures 29 and 31 of FIGS. 3, 5 and 6. Thus the base 11 is attached to the firearm 15 by mounting screws 25 and 27 and additionally a Z shaped hook is provided by the mounting base wherein the lug 17 prevents the base from shifting during recoil relative to the firearm 15 and lug 21 prevents the sight 13 from shifting relative to the base during recoil.

Figure 9:
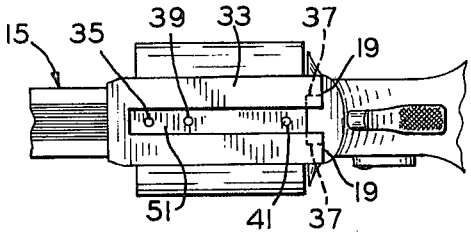
FIG. 9 illustrates the exemplary firearm of FIG. 1 after removal of the factory supplied adjustable iron sight and before the mounting base of the present invention is affixed thereto.

Turning briefly to FIG. 9, the factory supplied adjustable rear iron sight has been removed from the top strap 33, or, in the case of some semiautomatic pistols, from the slide by removing a screw from the threaded aperture 35 which in conjunction with a vertical adjustment stud which engaged a slot 37 functioned to hold the rear iron sight in place. The only additional preparation of the firearm required prior to the attachment of the mounting base is the provision of a pair of tapped mounting screw holes 39 and 41 to accept the screws 25 and 27 respectively. Of course in some cases existing threaded holes such as 35 or such a hole in conjunction with the threaded stud which fits into the recess 37 may be used in addition to, or instead of, the additional threaded holes 39 and 41.

Figure 8:
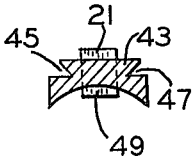
FIG. 8 is an end view in cross section of the mounting base of FIG. 1.

FIGS. 3 thru 8 depict the mounting base itself absent the means such as the pair of screws 25 and 27 for attaching the base to the firearm. FIG. 8 is a sectional view along a plane perpendicular to the direction of elongation of the base which direction corresponds generally to the axis of the bore of the firearm. FIG. 8 and the corresponding end view of FIG. 7 clearly show the upper dovetail portion 43 and the parallel grooves 45 and 47 formed thereby as well as the planar surface of the second recoil lug 21 and an optional downwardly depending portion 49 which may be provided to fit in the slot 51 of FIG. 9 previously vacated by the factory supplied iron sight. The underside of the base may be contoured as at 54 to fit the contour of the top strap 33.

Figure 5:
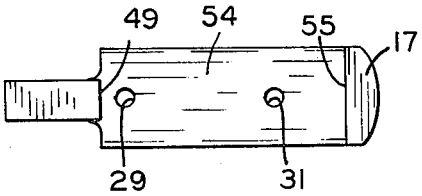
FIG. 5 is a bottom view of the mounting base of FIG. 1.
Figure 6:
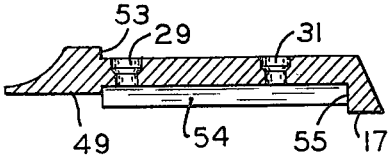
FIG. 6 is a side view in cross section of the mounting base of FIG. 1.

As seen in FIGS. 5 and 6, the planar surface 53 of recoil lug 21 and planar surface 55 of recoil lug 17 are generally parallel to one another and each perpendicular to the direction of elongation of the base and to the parallel grooves 45 and 47 extending longitudinally along the base. When assembled, planar surface 55 engages surfaces 19 on the firearm and planar surface 53 engages the planar recoil lug engaging surface 23 of the sight 13.

Figure 3:
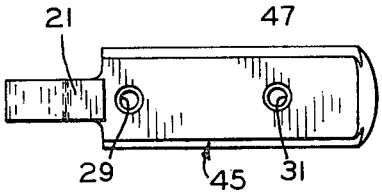
FIG. 3 is a top view of the mounting base of FIG. 1.
Figure 4:
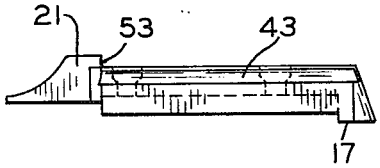
FIG. 4 is a side view of the mounting base of FIG. 1.

In FIG. 3 and more particularly FIG. 6, the mounting apertures 29 and 31 are seen to be countersunk so that the mounting screws 25 and 27 do not extend objectionably above the top surface of the dovetail portion 43 thus allowing unobstructed sliding of the sight 13 along the grooves 45 and 47 until that sight engages the front forward movement stop means 21. The contouring of the forward portion of the recoil lug 21 is primarily for appearance purposes.

Figure 2:
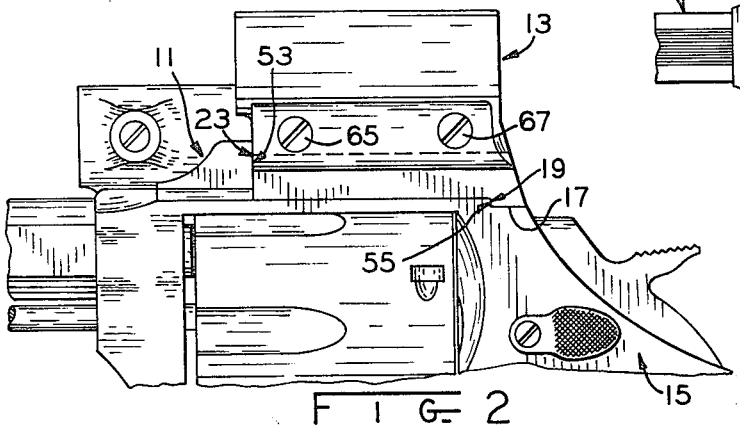
FIG. 2 is a side view similar to FIG. 1 but illustrating the optical sighting device in place on the base.

Returning to FIGS. 1 and 2, after the base 11 is secured by screws 25 and 27 to the firearm the sight 13 may be slid forwardly along the grooves 45 and 47 which are engaged respectively by a pair of spaced apart clamping legs 57 and 59 which have respective edge portions 61 and 63 having a contour generally complementary to that of the grooves for engaging those grooves. When the surfaces 23 and 53 are engaged the transversly extending tightening means such as screws 65 and 67 are tightened to draw the legs 57 and 59 together to firmly grip the base.

From the foregoing, it is now apparent that a novel optical sight mounting system as well as a novel mounting base are presented, meeting the objects and advantageous features set out hereinbefore, as well as others. When the firearm is discharged, recoil will tend to move it backward and recoil lug 17 will prevent the base from sliding toward the left as depicted with recoil lug 21 preventing the sight from sliding toward the left as illustrated, thereby preventing sight movement due to recoil. Further, it is contemplated that changes as to the arrangements, details and connections of the component parts may be made by those skilled in the art without departing from the spirit or scope of the invention, as set out in the claims which follow.

I claim:

1. An elongated mounting base for attaching an optical sighting device to a firearm comprising a dovetail portion extending in the direction of elongation to form a pair of spaced apart sight clamp accepting grooves extending parallel to one another in the direction of elongation, a first recoil lug extending away from the dovetail portion and generally perpendicular to the direction of elongation for engaging a firearm to prevent movement of the base relative to the firearm when the firearm is discharged, a second recoil lug extending away from the dovetail portion in a direction opposite the first recoil lug and generally perpendicular to the direction of elongation for engaging the sighting device to prevent movement of the sighting device relative to the base when the firearm is discharged, the base being provided with at least one aperture disposed substantially midway between the grooves and extending generally perpendicular to the direction of base elongation, and means for attaching the base to the firearm comprising at least one mounting screw for passing through the aperture in the base and into the firearm.

2. An elongated mounting base for attaching a sighting device to a firearm comprising a dovetail portion extending in the direction of elongation to form a pair of spaced apart grooves extending parallel to one another in the direction of elongation, the dovetail portion slidably accepting complementarily contoured portions of the sighting device, means for attaching the base to the firearm, and forward movement stop means for limiting the sliding movement of the sighting device in the direction of elongation relative to the base comprising a generally planar lug having a sight engaging surface extending generally perpendicular to the direction of elongation, a recoil lug extending away from the dovetail portion and generally perpendicular to the direction of elongation for engaging the firearm to prevent movement of the base relative to the firearm when the firearm is discharged, the recoil lug includes a generally planar surface for engaging the firearm, the two generally planar surfaces each disposed substantially perpendicular to the grooves and extending in opposite directions therefrom.

3. The mounting base of claim 2 wherein the base is provided with at least one aperture disposed substantially midway between the grooves and extending generally perpendicular to the direction of base elongation, the means for attaching comprising at least one mounting screw for passing through the apertures in the base and into the firearm.

4. An optical sight mounting system for a firearm comprising:

an elongated mounting base provided with a pair of spaced apart longitudinally extending grooves and at least one recoil lug extending generally perpendicular to the grooves including a generally planar surface for engaging a sighting device; and an optical sight having a pair of spaced apart clamping legs for slidably engaging the grooves and tightening means extending transversely between the legs to draw the legs toward each other to grip the base, the sight having a recoil lug engaging surface whereby the sight may be slidingly engaged with the base, slid forward toward the recoil lug until the surface engages the recoil lug, and the tightening means thereafter actuated to grip the base with the engaged lug and surface precluding further forward sliding movement of the sight relative to the base, the mounting base having at least one aperture and the mounting system including at least one mounting screw passing through the aperture and into the firearm in a direction generally perpendicular to the direction of base elongation, forward movement stop means including a generally planar surface for engaging the firearm, the two generally planar surfaces extending in opposite directions generally perpendicular to the direction of elongation, the stop means acting independent of the mounting screws for engaging the firearm to prevent movement of the base relative to the firearm when the firearm is discharged, the stop means thereby substantially preventing the application of shearing forces to the at least one screw when the firearm is discharged and recoils.

* * * * *